US009101530B2

(12) United States Patent
Wilson et al.

(10) Patent No.: US 9,101,530 B2
(45) Date of Patent: Aug. 11, 2015

(54) DISPOSABLE CONTENT USE MONITORING PACKAGE WITH A REMOVABLE RE-USABLE ELECTRONIC CIRCUIT BOARD

(75) Inventors: Allan Wilson, Ottawa (CA); Michael Petersen, Ottawa (CA); Dean Brotzel, Ottawa (CA)

(73) Assignee: Intelligent Devices, Inc., Belleville, St. Michael (BB)

( * ) Notice: Subject to any disclaimer, the term of this patent is extended or adjusted under 35 U.S.C. 154(b) by 33 days.

(21) Appl. No.: 13/881,782

(22) PCT Filed: Oct. 26, 2011

(86) PCT No.: PCT/CA2011/001189
§ 371 (c)(1),
(2), (4) Date: May 2, 2014

(87) PCT Pub. No.: WO2012/055021
PCT Pub. Date: May 3, 2012

(65) Prior Publication Data

US 2015/0164741 A1 Jun. 18, 2015

(30) Foreign Application Priority Data

Oct. 27, 2010 (CA) ..... 2719054

(51) Int. Cl.

| | |
|---|---|
| ***B65D 75/00*** | (2006.01) |
| ***A61J 1/03*** | (2006.01) |
| ***B65B 11/52*** | (2006.01) |
| ***B65B 7/28*** | (2006.01) |
| ***B65B 69/00*** | (2006.01) |

(Continued)

(52) U.S. Cl.
CPC .. *A61J 1/035* (2013.01); *A61J 7/02* (2013.01); *A61J 7/04* (2013.01); *B65B 7/28* (2013.01); *B65B 11/52* (2013.01); *B65B 69/005* (2013.01)

(58) Field of Classification Search
USPC ..... 206/528, 529, 531, 532, 534.1, 538
See application file for complete search history.

(56) References Cited

U.S. PATENT DOCUMENTS 5,339,960 A * 8/1994 Price ..... 206/531
6,411,567 B1 6/2002 Niemiec et al.

(Continued)

FOREIGN PATENT DOCUMENTS

CA 2212112 8/1997

OTHER PUBLICATIONS

International Search Report and Written Opinion issued in International Patent Application No. PCT/CA2011/001189 dated Jan. 19, 2012.

*Primary Examiner* — Jacob K Ackun
(74) *Attorney, Agent, or Firm* — Frank M. Scutch, III

(57) ABSTRACT

There is provided a content use monitoring package and method of making the same. The package includes a cover layer followed by a blister card layer. The third layer comprises an electronic sensor monitoring tag connected to a rupturable layer imprinted with a conductive grid. The grid is printed on a non-conductive, non paperboard rupturable substrate and is aligned with associated blisters in the blister card. To ensure precise and reliable electrical continuity between the tag and grid they are connected by a low or zero insertion force flat flex connector which connection is also reversible. The tag includes re-usable electronic circuitry and power source. The fourth and bottom layer is a backing which contains a mechanism to tear open the package and remove the tag by unplugging the flex circuit connector. The tag can then be reused and the battery replaced as required.

20 Claims, 9 Drawing Sheets

(51) Int. Cl.
*A61J 7/02* (2006.01)
*A61J 7/04* (2006.01)

(56) References Cited

U.S. PATENT DOCUMENTS 7,113,101 B2 9/2006 Petersen et al.
7,489,594 B2 * 2/2009 Simon et al. ..... 368/10
7,644,821 B2 * 1/2010 Perell ..... 206/532
7,699,174 B2 * 4/2010 Allison et al. ..... 206/531
7,726,485 B2 * 6/2010 Brollier ..... 206/534
8,960,440 B1 * 2/2015 Kronberg ..... 206/531
2006/0144747 A1 7/2006 Le et al.
2007/0221534 A1 * 9/2007 Intini ..... 206/532
2007/0246399 A1 10/2007 Picard et al.
2008/0053040 A1 * 3/2008 Petersen et al. ..... 53/396
2008/0191174 A1 8/2008 Ehrensvard et al.
2008/0197043 A1 * 8/2008 Freeze et al. ..... 206/538
2009/0184023 A1 * 7/2009 Brollier et al. ..... 206/531
2009/0194452 A1 8/2009 Hession et al.
2009/0277815 A1 * 11/2009 Kohl ..... 206/531
2010/0298975 A1 * 11/2010 Heath et al. ..... 700/237

* cited by examiner

DISPOSABLE CONTENT USE MONITORING PACKAGE WITH A REMOVABLE RE-USABLE ELECTRONIC CIRCUIT BOARD

CROSS REFERENCE TO RELATED APPLICATIONS

This application is a U.S. nationalization under 35 U.S.C. §371 of International Application No. PCT/CA2011/001189, filed Oct. 26, 2011, which claims priority to Canadian Application No. 2,719,054, filed Oct. 27, 2010. The disclosures set forth in the referenced applications are incorporated herein by reference in their entireties.

TECHNICAL FIELD

The present invention relates to a method for making a content use monitoring package and the package itself. The package has a removable re-usable electronic circuit board.

BACKGROUND INFORMATION

Allan Wilson, Michael Petersen, Ehrensvaerd Jakob and Grip Stina, amongst others, have described devices for monitoring, recording and downloading medication dispensing histories for blister packaged medication; see for example U.S. Pat. Nos. 7,113,101, 7,178,417, 6,628,199, 6,244,462, 7,170,409, 6,616,035, 7,616,116 and 7,772,974 along with PCT application having publication number WO/2009/135283. Also see Canadian application No. 2353350 and U.S. Publication Nos. 20070278285, 20080191174 and 20080053222.

Such devices broadly comprise sensor detecting/monitoring electronic tags, sensor grids printed with conductive ink, means of connecting the two and means of inserting the device in a pharmaceutical blister package.

Despite having been marketed and tested for ten years, the success of any current technology for medication monitoring of blister packages has been severely limited. A need has been identified for further refinements of such devices to address problems with the current technologies. These include:

difficulty connecting the flexible substrate grid physically and electrically to the rigid tag instability of conductive inks printed on paperboard substrates yielding unreliable electrical characteristics tendency of printed conductive inks to crack under repeated deformation (bending)

cost of conductive inks difficulty tearing or breaking the substrate with normal tablet expulsion cost of the sensor monitoring tag The pharmaceutical market wants a medication monitoring device that is:

cheap 100 percent reliable fits seamlessly into the packaging process is easy for the consumer to use has a reusable electronic module allows for the use of breakable substrates to facilitate consumer use allows for the use of thin substrates to minimize package bulk can accommodate optional functionality including reminders, data input buttons, and LED and LCD displays, etc.

can accommodate optional printed devices including humidity and temperature sensors, printed wireless communication including capacitive coupled, RFID, HF, UHF, Bluetooth and NFC, and OLED displays, printed batteries etc

SUMMARY OF THE INVENTION

The present invention addresses the limitations of prior art and meets the criteria set forth herein. The invention contemplates in one aspect a means of attaching a sensor monitoring electronic tag to a flexible dielectric substrate on which has been printed a conductive grid so as to ensure precise and reliable electric continuity between the two. Tags so connected can then be used to monitor either digital (one trace per opening) or analog (such as resistive ladder array) printed grids.

Such means is also reversible to allow reuse of the tag with new printed grids in new packages thereby reducing cost.

This means allows the use of ultra thin (e.g.: Mylar™, food grade plastic, etc.) printed grid substrates to facilitate consumer use by easy and predictable breaking of the substrate and conductive grid by tablet expulsions from the associated blister. Such non paperboard substrates are humidity stable and give more reliable electrical characteristics to the printed grid, minimizing false or missed expulsion events.

Thin substrates are easily attached to the blister card (usually by use of self-adhesive backing), and also contribute to easy consumer use by minimizing package thickness.

Preferably a low or zero insertion force (ZIF) flex circuit connector is used to connect the input pads of an electronic sensor monitoring tag to the output traces of a conductive grid printed on thin Mylar, food grade plastic or similar substrate. At the time of assembly the two components of the flex circuit connector are snapped together.

This confers major advantages to prior art:

1) Robust electrical continuity between grid and tag giving fewer false events due to physical deformation of the package by the user or changes in humidity affecting the grid substrate.
2) Precise alignment of electrical contacts permitting the use of multiple conducting traces, which in turn permits the use of either digital or analog grid designs.
3) Accurate alignment facilitates thinner conducting traces for more complex blister package designs.
4) Thinner conducting traces save on the cost of conductive ink, lowering package costs and reducing the cost to the environment.
5) Thinner conducting traces leave more unused space on the grid for add-ons such as push buttons to record user data, reminders, LCD, LED and OLED displays, etc.
6) After use the blister package can be disassembled and the tag separated from the grid and reused with a new grid in a new package saving considerable cost (up to 99% if re-used 100 times).
7) Use of a thin breakable grid substrate facilitates the breaking of the grid in a predictable manner during tablet expulsion from the blister contributing to user friendliness and minimizing errors due to unreliable breaking of the conducting traces
8) Use of thin robustly attached grids contributes to seamless insertion into the blister package during assembly.
9) Printing conducting traces on separate inlays (self-adhesive or otherwise) removes an intricate process from the process of manufacturing the surrounding blister card paperboard, allowing separate QA of such inlays and pre-manufacturing of complete inlay assemblies (tag connected to trace inlay).

Using a ZIF flat flex connector confers several advantages to existing prior art including:

Increases reliability by keeping the flexible grid and rigid tag in electrical continuity thus eliminating a major source of error in current art, namely spurious use data caused by stress on the package and resulting electrical continuity fluctuations.

Reduces the requirement for thick, wide printed traces to minimize such continuity aberrations.

Furthermore, the use of batteries printed on otherwise unused areas of the grid surface can free up space on the tag allowing for the use of smaller such devices contributing to the efficiency of the package building process.

In one aspect of the present invention there is provided a method of making a content use monitoring package comprising the steps of aligning a blister card having blisters on a top side with a cover having cut-outs so the blisters of the blister card are aligned with the respective cut-outs of the cover; connecting an electronic sensor monitoring tag having re-usable electronic circuitry and power source to a conductive grid printed on a thin flexible substrate so the tag and grid are in electrical continuity to form a monitoring device; aligning the conductive grid with the blisters on the blister card and optionally fixing it via self-adhesive backing to the blister; obtaining a backing having cut-outs corresponding to the blister positions of the blister card and having a die-cut pull-out corresponding to the position of the tag on the monitoring device; and sealing the backing to the cover with the blister card and monitoring device sandwiched between; wherein the tag is removable by opening the pull-out and unplugging the tag from the grid.

In another aspect of the present invention there is provided a content use monitoring package comprising: a blister card having blisters on a top side and having a bottom side; a cover having cut-outs aligned with the blisters of the blister card; an electronic sensor monitoring tag having re-usable electronic circuitry and power source; a conductive grid printed on a thin flexible substrate and connected to the tag so the tag and grid are in electrical continuity to form a monitoring device; and a backing having cut-outs corresponding to the blister positions of the blister card and having a die-cut pull-out corresponding to the position of the tag on the monitoring device; wherein the backing is sealed to the cover with the blister card and monitoring device sandwiched between and the conductive grid aligned with the positions of the blisters on the bottom side of the blister card; and wherein the tag is removable by opening the pull-out and unplugging the tag from the grid.

BRIEF DESCRIPTION OF THE DRAWINGS

The invention will be further understood from the following description with reference to the attached drawings in which.

DETAILED DESCRIPTION OF THE PREFERRED EMBODIMENTS

One embodiment of the present invention includes a content use monitoring package such as used for monitoring the taking of blister-packaged medication doses. The package has a removable re-usable electronic circuit board (tag) and also contains a rupturable layer imprinted with conducting and/or sensing circuitry printed thereon by additive conductive methods such as flexographic, inkjet, offset, metal vapour deposition, gravure or screen printing methods, or by subtractive or other suitable methods. The circuitry is no thicker than 2 microns and typically less than 0.5 micron, available from Conductive Inkjet Technology, for example. The circuitry is preferably printed on a tough and resilient Mylar base material. The thickness of the Mylar substrate can be varied to optimize predictable rupturing of the printed traces. Mylar is an excellent dielectric at these thicknesses.

The re-usable sensor monitoring tag contains a power source, communication interface and/or RFID wireless interface antenna, central processor, and a flat flex connector for the printed flexible conductive monitoring grid. Ideally, the height of the device (tag attached to the grid) including any associated components should not exceed 2.5 mm to enable complete and seamless integration of the device into the consumer package.

The package also contains an optional means of easy access to and removal of the tag after the package content has been consumed, such as a pull-tab or other mechanism to tear open the package and allow removal of the tag for re-use. The battery can be replaced as required, increasing the number of reuses of the tag. There can be an algorithm contained in the tag firmware which tracks battery usage and recommends replacement of battery between uses.

Figure 1:
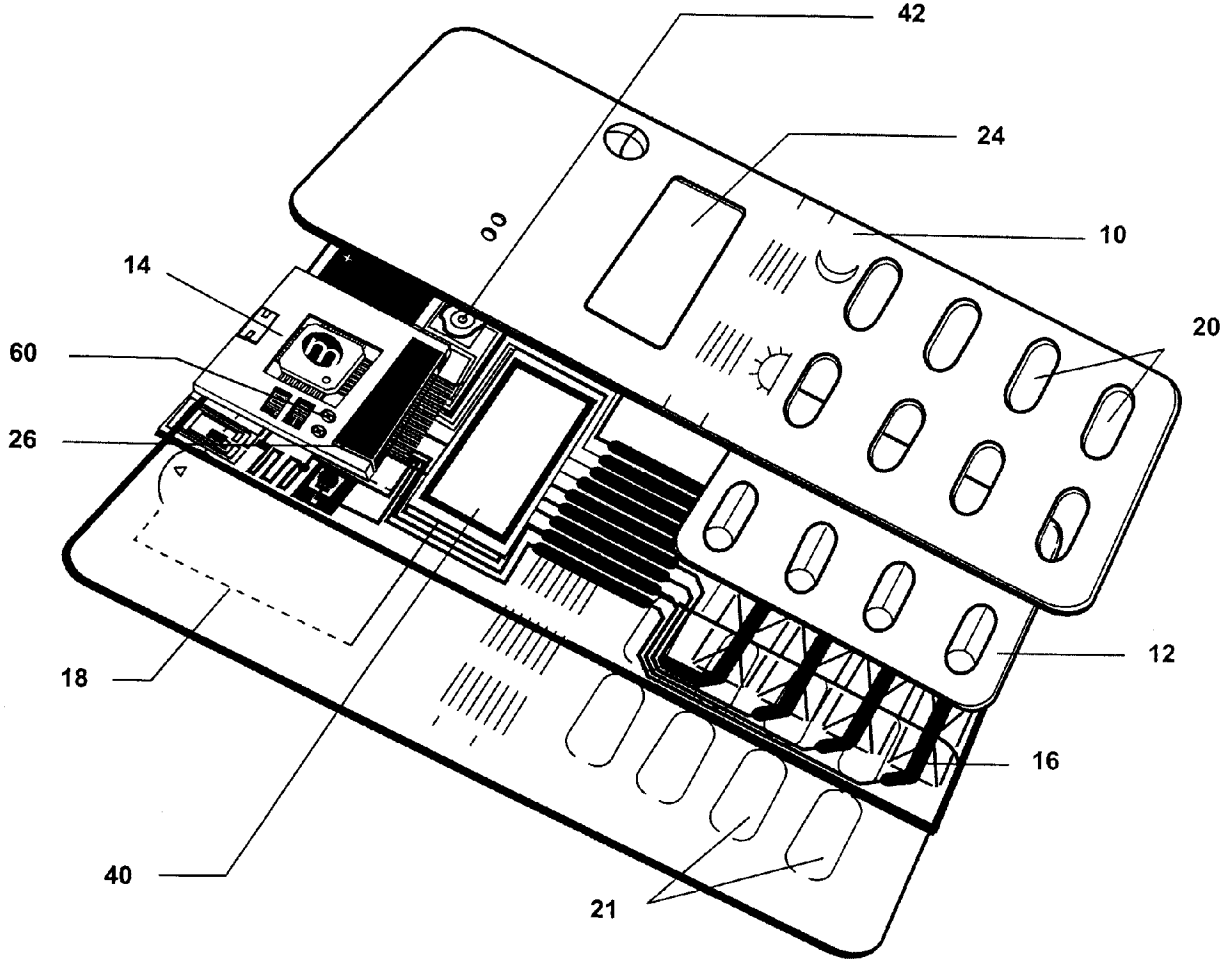
FIG. 1 shows the content use monitoring package in a disassembled state, showing each layer therein.

FIG. 1 of the present invention shows the various layers of the package. The cover 10 or top layer is preferably made of Easy Seal® paperboard or similar material commonly used in the food and pharmaceutical packaging industry. This is followed by a medication blister card 12 underneath with each blister aligned with a cut-out 20 in the cover 10. The third layer comprises a reusable electronic sensor monitoring tag 14 connected to a conductive grid 16 printed on thin Mylar, plastic or similar substrate by a flat flex connector 26 which connection is reversible by unplugging. The grid 16 is rupturable and is aligned with the associated blisters and may or may not contain a self adhesive layer with removable liner. The fourth and bottom layer is a backing made of Easy Seal® or other paperboard die cut to form a pull-out tab 18 to tear open the used package and allow the tag 14 to be removed from the package by unplugging the connector 26. The tag 14 can then be reused in conjunction with a new printed grid and its battery replaced as required. The backing has cut-outs 21 associated with the cut-outs 20 in the cover 10. The conductive grid can be optionally adhered to the blister card with any form of suitable self-adhesive means.

Figure 2B:
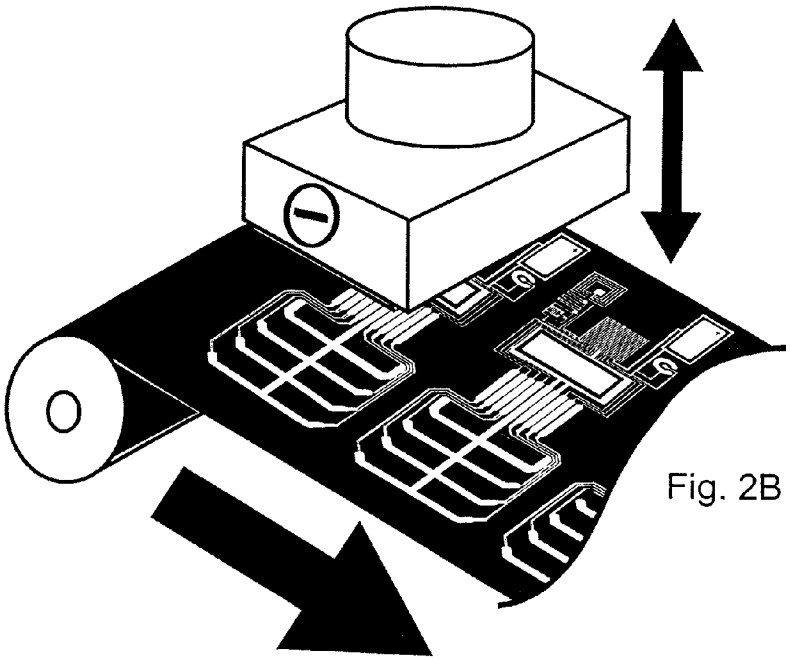
FIG. 2B shows printing of the conductive grid with a subtractive printing process.
Figure 2A:
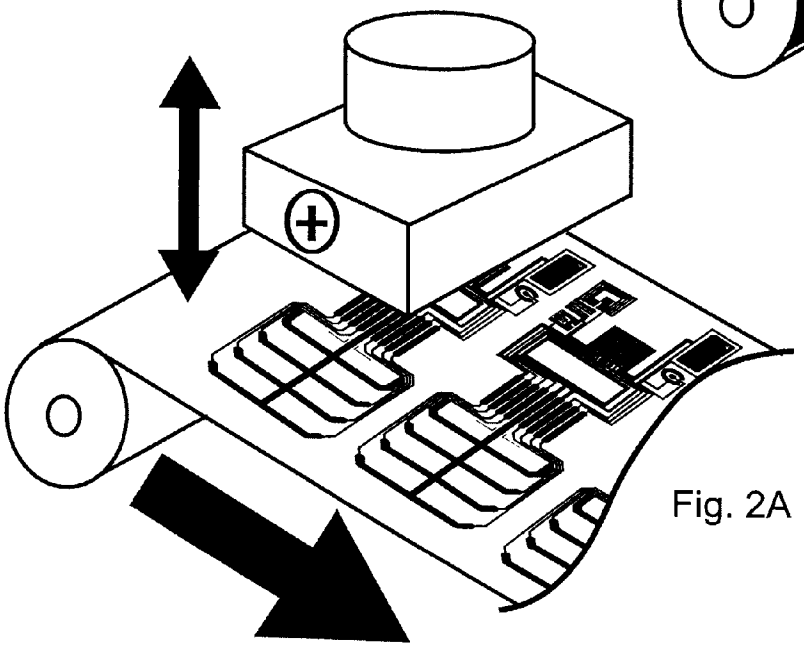
FIG. 2A shows printing of the conductive grid with an additive printing process, or application using vacuum metal vapour deposition technology.

FIG. 2A shows one manner of printing the conductive grid by an additive printing process using conductive inks containing zinc, silver, aluminium, carbon or other conductive material. This can be accomplished using standard flexographic, screenprint, inkjet, offset, etc printing methods. Also shown in FIG. 2B is the subtractive printing process in which the dielectric Mylar or similar substrate has been coated with a conductive substance that is subsequently removed by die-cutting or chemical etching to leave behind the conductive traces of the grid. It is also possible to produce a subtractive process by die-cutting thin flexible foils and applying them onto a dielectric surface.

Figure 3:
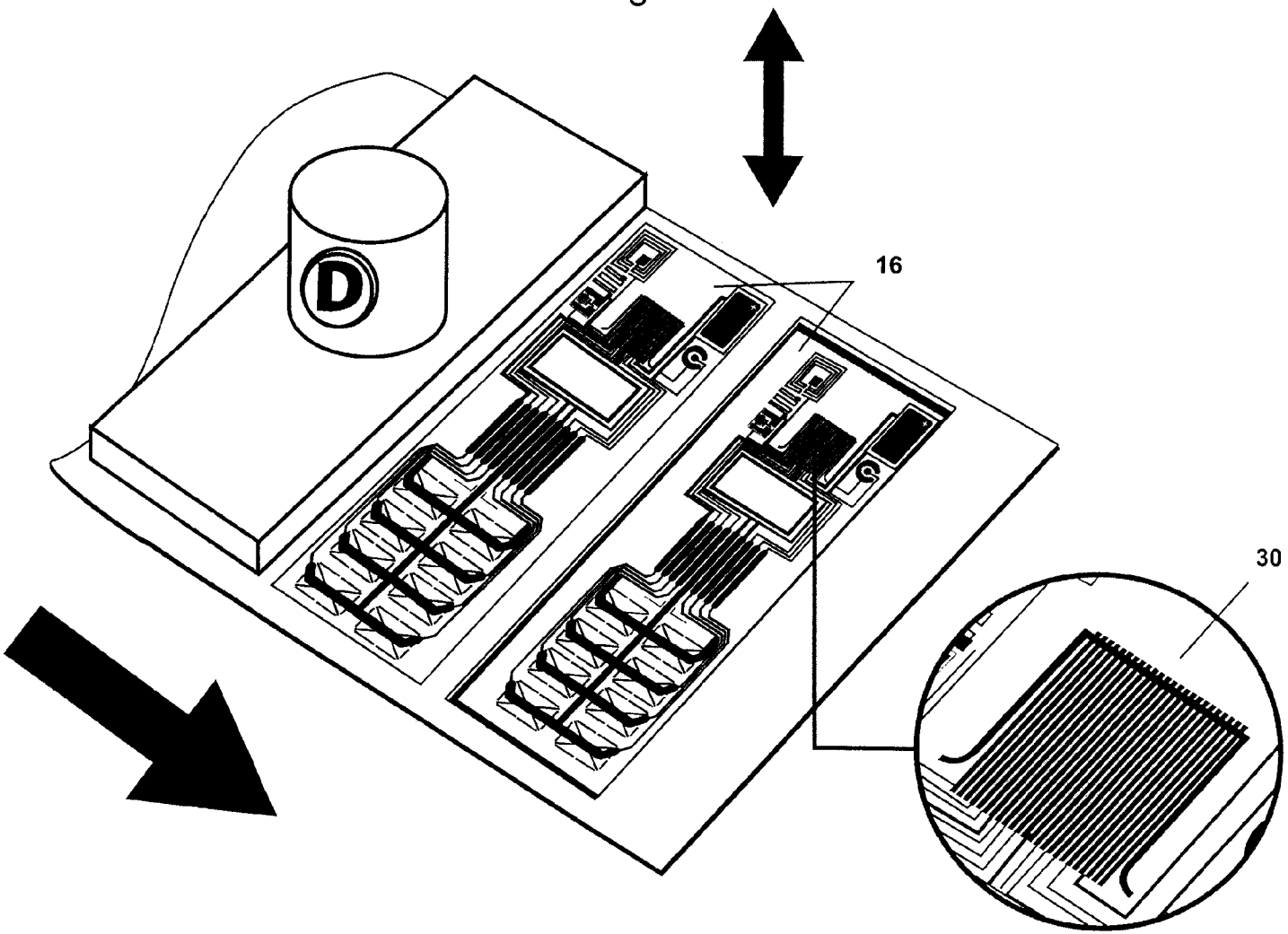
FIG. 3 depicts die-cutting the printed grid to create the interface with one part of the flat flex connector.

FIG. 3 shows how the grid contacts for the flat flex connector are die-cut from the printed grid for precise alignment with the contacts of the flat flex connector. Precise alignment is important if numerous conductive traces are to be connected to the tag as in digital grid designs having many individual circuits. The flat cable wires 30 for the flat flex connector are die-cut from the grid inlay as shown in the expanded view. The grid inlay is also die-cut to create flat connector wires along with the blister opening pattern and to ensure a fit with the paperboard.

Figure 4:
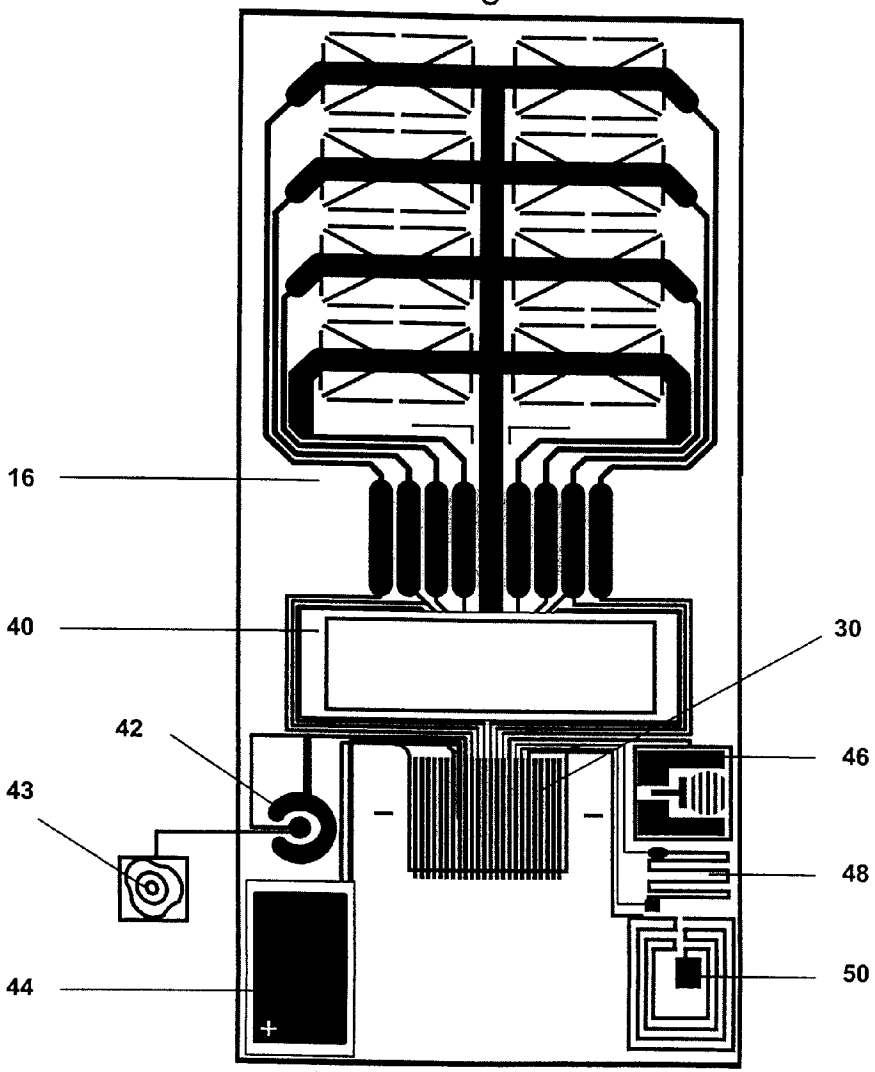
FIG. 4 shows optional printed functions that can be accommodated because of the space savings resulting from the more accurate printing of the conductive grid.

In FIG. 4 a number of optional printed functions are shown that are made possible by the increased empty space on the grid substrate due to the decreased area required for the more accurately printed die-cut conductive traces. For example, areas can be allotted to an organic LED (OLED) display 40, a printed input button 42 for users to input data to the tag (such as a self-adhesive metal dome button 43), a printed battery 44, printed humidity sensors 46, printed or applied temperature sensors 48, and a variety of communication modes 50 including Capacitive Coupled, RFID, HF, UHF, Bluetooth, GSM and NFC. Use of a battery printed on the grid allows for a smaller tag, further contributing to cost savings and ease of inserting the monitoring device into existing assembly processes. Some printed batteries can take on organic shapes, fitting themselves into available open space, rather than requiring a particular geometric area. If an OLED display 40 is provided, the cover 10 will have a window 24 to view the display (FIG. 1).

Figure 5:
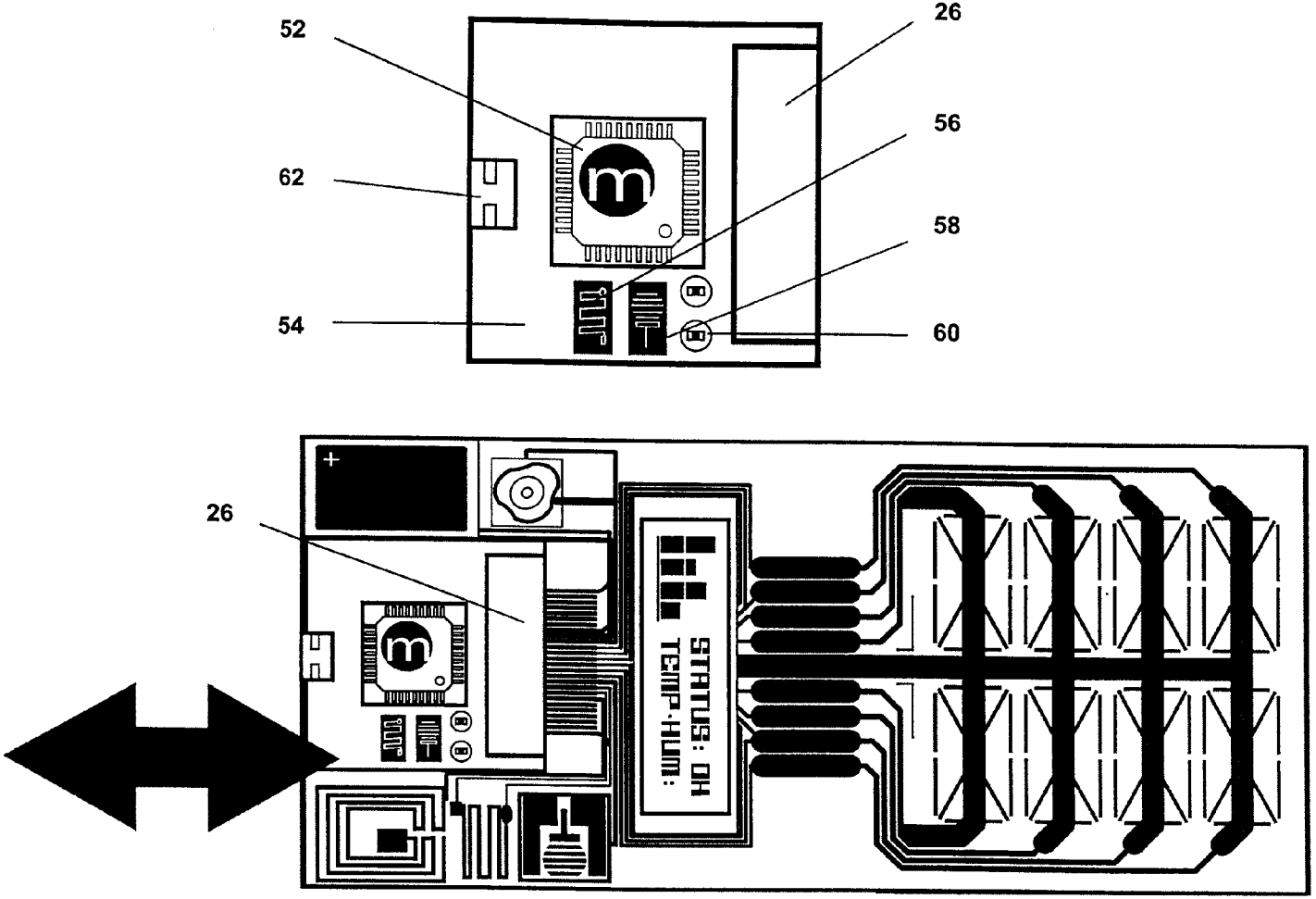
FIG. 5 shows the connection of tag and grid by flat flex connector.

FIG. 5 shows the means of connecting the sensor monitoring tag 14 to the printed grid 16 using a two-part reversible flat flex connector 26. The tag 14 has a microchip 52 and protective foam 54. Other optional components include an on-board temperature sensor 56, on-board humidity sensor 58 or indicator LEDs 60. The tag 14 can also optionally include wired communication 62 such as a micro-B USB plug.

Figure 6A:
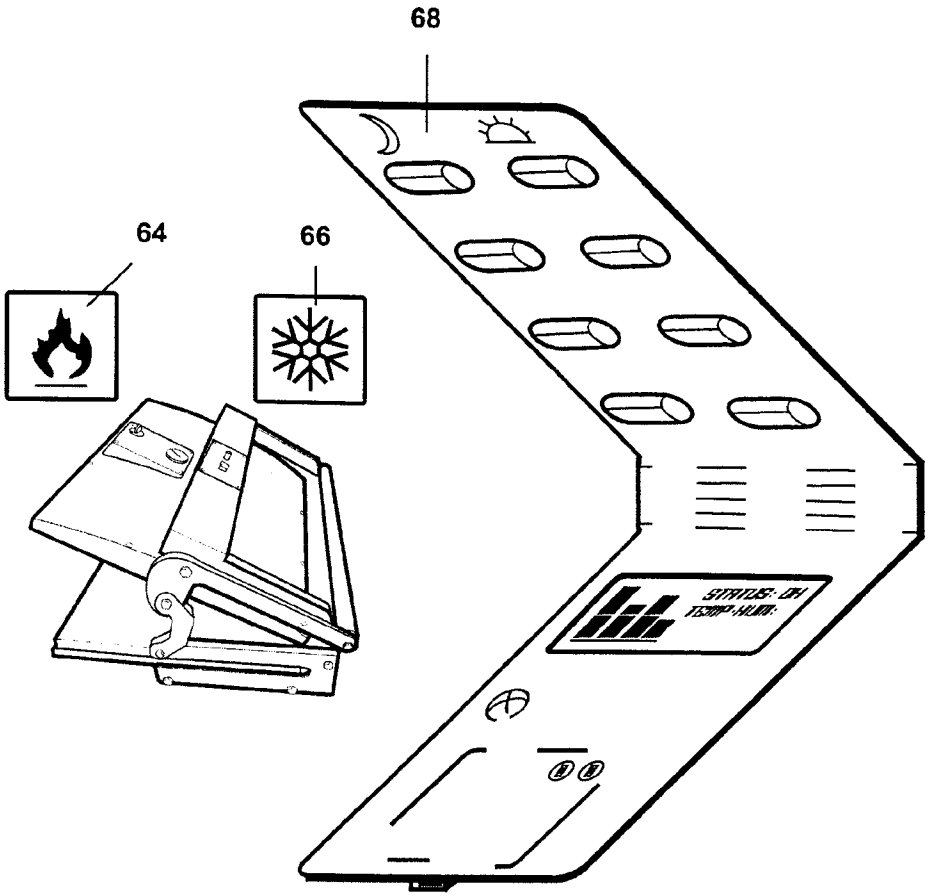
FIG. 6A shows the finished package in an open state after heat or cold sealing.
Figure 6B:
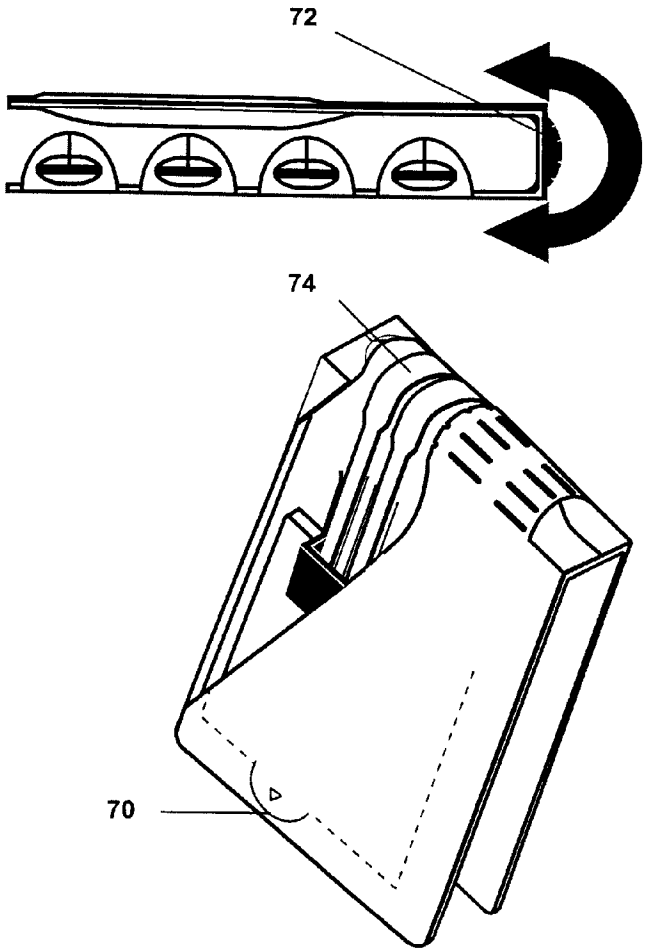
FIG. 6B shows the finished package in a closed state with the unique die-cut spine.

In FIG. 6A the completed medication compliance package 68 is shown in an open state with the monitoring device (tag connected to grid) and the medication blister card hot 64 or cold 66 sealed between two layers of paperboard. FIG. 6B shows two instances of the medication package 68 in a closed state and the location of the pull-out 70 for tag removal. The spine 72 is rounded by die-cutting so the printed conductive traces 74 bend smoothly across the spine 72 and are less likely to be damaged by opening and closing cycles.

Figure 7:
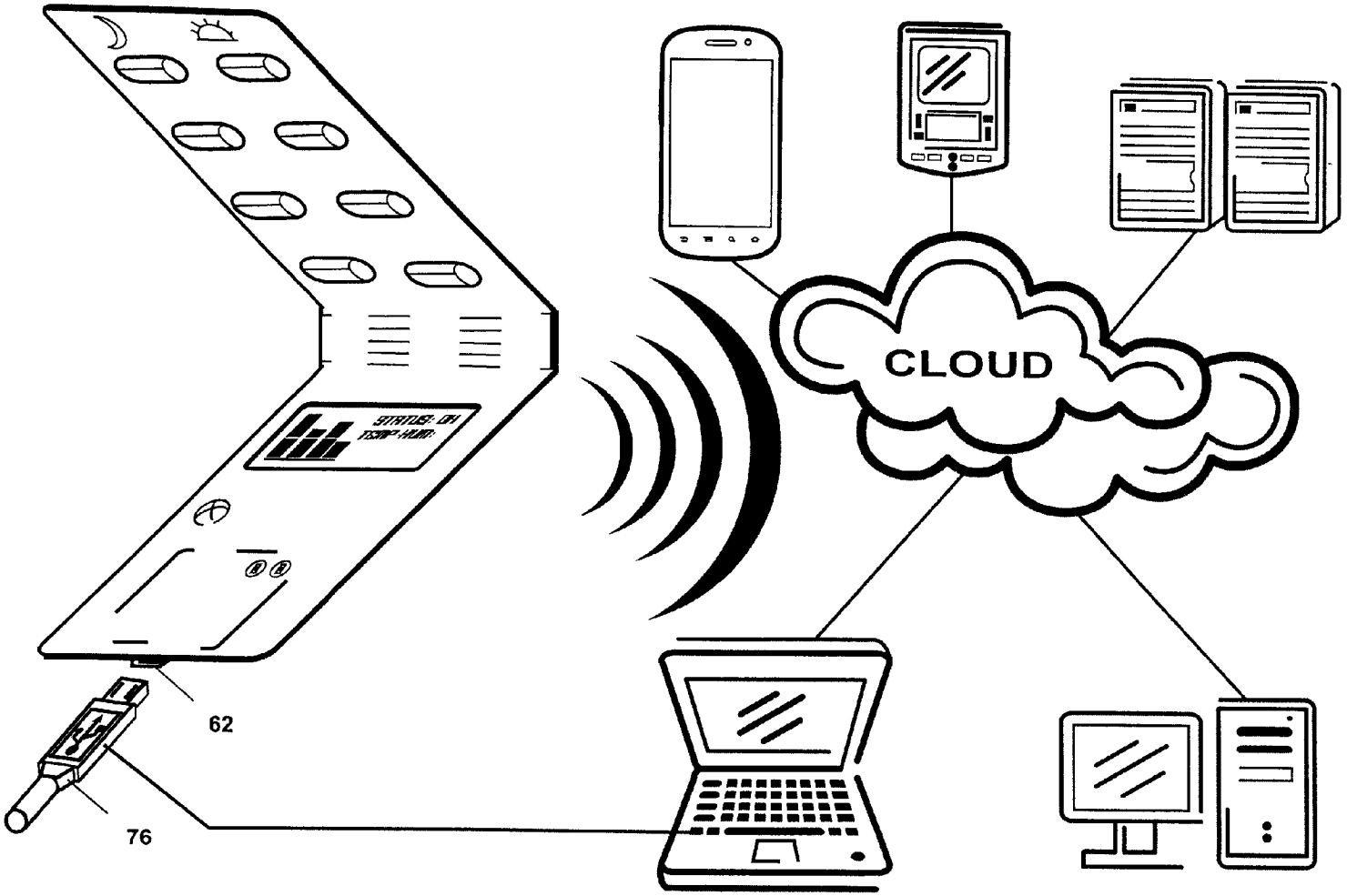
FIG. 7 shows hard wired and wireless communication of data from the package to computers, PDAs and data storage devices.

FIG. 7 shows both hard wired and wireless means by which the data from the tag 14 can be transmitted to computers, PDAs, data servers or the cloud conferring great flexibility of use on the device. The wired communication port 62 can be used to connect for example by USB 76 to computer. Wireless communication means include Capacitive Coupled, RFID, HF, UHF, Bluetooth and NFC.

Figure 8:
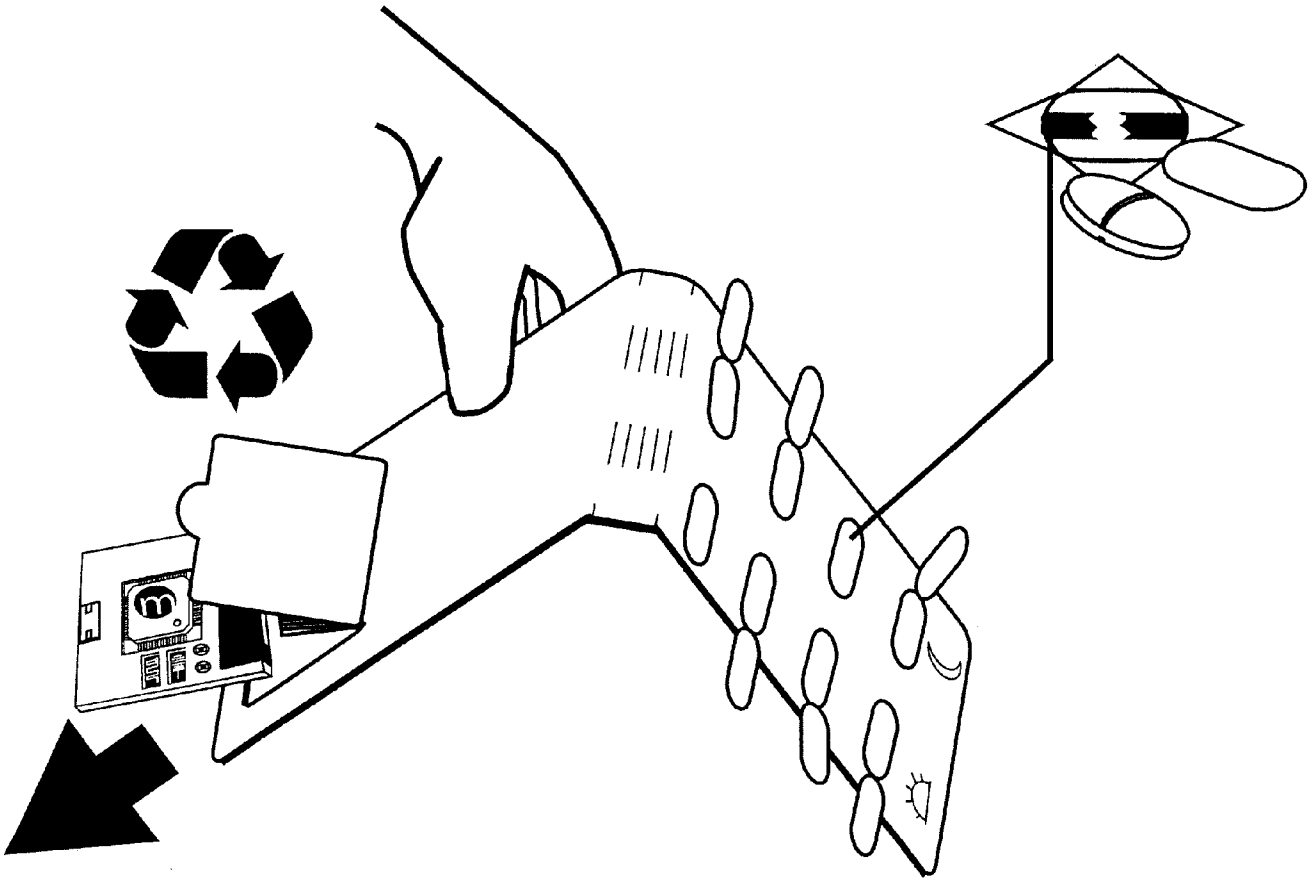
FIG. 8 shows means of recycling the tag after the package has been used.

FIG. 8 shows removal of the tag 14 from the used package by opening the pull-tab and unplugging the flat flex connector. The tag is then recycled, refurbished if required by adding a new power source, reprogrammed if required and attached to a new conductive grid to be inserted in a new package. The grid and paperboard are disposable. FIG. 8 also shows in expanded view how an event is triggered when the conductive trace is broken and the medication is pushed through the blister.

It will be appreciated by one skilled in the art that variants can exist in the above-described material and package layout. The scope of the claims should not be limited by the preferred embodiments set forth in the examples given above, but should be given the broadest interpretation consistent with the description as a whole.

What is claimed is:

1. A method of making a content use monitoring package comprising the steps of:

aligning a blister card having blisters on a top side with a cover having cut-outs so the blisters of the blister card are aligned with the respective cut-outs of the cover;

connecting an electronic sensor monitoring tag having re-usable electronic circuitry and power source to a conductive grid printed on a thin flexible substrate so the tag and grid are in electrical continuity to form a monitoring device;

aligning the conductive grid with the blisters on the blister card;

obtaining a backing having cut-outs corresponding to the blister positions of the blister card and having a die-cut pull-out corresponding to the position of the tag on the monitoring device; and sealing the backing to the cover with the blister card and monitoring device sandwiched between;

wherein the tag is removable by opening the pull-out and unplugging the tag from the grid.

2. The method of claim 1, wherein the step of connecting the tag to the grid is made with a flat flex circuit connector.

3. The method of claim 2, wherein the flat flex circuit connector is a low or zero insertion force connector.

4. The method of claim 3, wherein the tag is removable by unplugging the tag from the connector.

5. The method of claim 1, wherein the blisters contain tablets.

6. The method of claim 5, further comprising the step of removing a tablet through the backing cut-out by pushing the tablet through the cover cut-outs and in so doing rupturing the conductive grid portion associated with the one of the blisters.

7. The method of claim 1, wherein the substrate is made of Mylar, plastic or similar thin flexible material.

8. The method of claim 1, further comprising the step of providing a pull-tab on the pull-out for removing the pull-out by pulling on the pull-tab.

9. The method of claim 1, further comprising the step of adhering the conductive grid to the blister card with self-adhesive means.

10. A content use monitoring package comprising:

a blister card having blisters on a top side and having a bottom side;

a cover having cut-outs aligned with the blisters of the blister card;

an electronic sensor monitoring tag having re-usable electronic circuitry and power source;

a conductive grid printed on a thin flexible substrate and connected to the tag so the tag and grid are in electrical continuity to form a monitoring device; and a backing having cut-outs corresponding to the blister positions of the blister card and having a die-cut pull-out corresponding to the position of the tag on the monitoring device;

wherein the backing is sealed to the cover with the blister card and monitoring device sandwiched between and the conductive grid is aligned with the positions of the blisters on the bottom side of the blister card; and wherein the tag is removable by opening the pull-out and unplugging the tag from the grid.

11. The content use monitoring package of claim 10, further comprising a flat flex circuit connector for connecting the tag to the grid.

12. The content use monitoring package of claim 11, wherein the flat flex circuit connector is a low or zero insertion force connector.

13. The content use monitoring package of claim 12, wherein the tag is removable by unplugging the tag from the connector.

14. The content use monitoring package of claim 10, wherein the blisters contain tablets.

15. The content use monitoring package of claim 14, wherein the tablets are removed from the blisters through the backing cut-outs by pushing on the blisters through the cover cut-outs.

16. The content use monitoring package of claim 14, wherein the conductive grid portion is ruptured when a tablet is expelled through a cut-out associated with the tablet.

17. The content use monitoring package of claim 15, wherein the conductive grid portion is ruptured when a tablet is expelled through a cut-out associated with the tablet.

18. The content use monitoring package of claim 10, wherein the substrate is made of Mylar, plastic or similar thin flexible material.

19. The content use monitoring package of claim 10, further comprising a pull-tab on the pull-out for removing the pull-out by pulling on the pull-tab.

20. The content use monitoring package of claim 10, wherein the conductive grid is adhered to the blister card with self-adhesive means.

* * * * *